US008694204B2

(12) United States Patent
Reeb et al.

(10) Patent No.: US 8,694,204 B2
(45) Date of Patent: Apr. 8, 2014

(54) VEHICLE AND METHOD FOR OPERATING A VEHICLE

(75) Inventors: Jörg Reeb, Merzig (DE); Markus Roth, Newel (DE); Judith Britten, Völklingen (DE); Uwe Müller, Föhren (DE)

(73) Assignee: Volvo Construction Equipment AB, Eskilstuna (SE)

( * ) Notice: Subject to any disclaimer, the term of this patent is extended or adjusted under 35 U.S.C. 154(b) by 168 days.

(21) Appl. No.: 13/264,757

(22) PCT Filed: Apr. 17, 2009

(86) PCT No.: PCT/SE2009/000200

§ 371 (c)(1), (2), (4) Date: Oct. 31, 2011

(87) PCT Pub. No.: WO2010/120216

PCT Pub. Date: Oct. 21, 2010

(65) Prior Publication Data

US 2012/0065840 A1 Mar. 15, 2012

(51) Int. Cl.
*E02F 9/24* (2006.01)

(52) U.S. Cl.
USPC ..... 701/36; 701/50

(58) Field of Classification Search
USPC ..... 701/50, 36
See application file for complete search history.

(56) References Cited

U.S. PATENT DOCUMENTS

| | | | | | |
|---|---|---|---|---|---|
| 3,285,430 | A * | 11/1966 | Whitmire | ..... | 212/280 |
| 5,949,359 | A * | 9/1999 | Vlahu | ..... | 341/116 |
| 5,997,013 | A | 12/1999 | Claxton | | |
| 6,170,681 | B1 * | 1/2001 | Yoshimatsu | ..... | 212/278 |
| 6,191,550 | B1 * | 2/2001 | Yoshihara | ..... | 318/661 |
| 7,055,269 | B2 * | 6/2006 | Lovato | ..... | 37/417 |
| 8,272,521 | B1 * | 9/2012 | Kemmerly et al. | ..... | 212/278 |
| 2008/0140278 | A1 * | 6/2008 | Breed | ..... | 701/29 |

FOREIGN PATENT DOCUMENTS

| | | | | | |
|---|---|---|---|---|---|
| CN | 200949020 | Y * | 9/2007 | ..... | B66C 23/94 |
| EP | 210927 | A1 * | 2/1987 | ..... | H02K 24/00 |
| EP | 1426207 | A2 | 6/2004 | | |
| EP | 1541773 | A2 * | 6/2005 | ..... | E02F 9/24 |
| EP | 1849931 | A2 | 10/2007 | | |

(Continued)

OTHER PUBLICATIONS

EPO machine translation of FR 2497851 (original FR document published Jul. 16, 1982).*

(Continued)

*Primary Examiner* — Behrang Badii
*Assistant Examiner* — David Testardi
(74) *Attorney, Agent, or Firm* — WRB-IP LLP

(57) ABSTRACT

A vehicle includes at least one of (i) an undercarriage and an upper carriage arranged rotatably about a vertical axis with respect to the undercarriage and (ii) a leverage means arranged pivotably about a horizontal axis with respect to the upper carriage, wherein a sensor system is provided for monitoring at least one stability criterion with respect of a tilt movement of the vehicle, and wherein a control unit is coupled to the sensor system for automatically initiating an action and/or performing an action for stabilizing the vehicle depending on the at least one stability criterion. The risk of an unexpected tilting of the vehicle can be reduced.

13 Claims, 8 Drawing Sheets

(56) References Cited

FOREIGN PATENT DOCUMENTS

| | | | | | |
|---|---|---|---|---|---|
| FR | 2497851 | A | * | 7/1982 | ..... E02F 9/24 |
| FR | 2550520 | A | * | 2/1985 | ..... B66C 23/88 |
| GB | 2010193 | A | | 6/1979 | |
| GB | 2204014 | A | * | 11/1988 | ..... B66C 23/94 |
| JP | 5-43027 | Y | * | 10/1993 | ..... B66C 23/94 |
| JP | 07285799 | A | * | 10/1995 | ..... B66F 9/24 |
| JP | 08091780 | A | * | 4/1996 | ..... B66C 23/94 |
| WO | 9627548 | A1 | | 9/1996 | |

OTHER PUBLICATIONS

JPO machine translation of JP 07-207711 (original JP document published Aug. 8, 1995).*

International Search Report for corresponding International Application PCT/SE2009/000200, (Dec. 14, 2009).

International Preliminary Report on Patentability for corresponding International Application PCT/SE2009/000200 (Jul. 5, 2011).

JP07207711A (abstract) Yutani Heavy Ind Ltd., Aug. 8, 1995 and original document.

* cited by examiner

VEHICLE AND METHOD FOR OPERATING A VEHICLE

BACKGROUND AND SUMMARY

The invention relates to a vehicle, particularly a working machine, and a method for operating a vehicle. More particularly, the invention relates to a vehicle with improved operation safety.

It is known in the art that working machines such as excavators that are equipped with a pendulum axle and a pivotable boom can meet operating conditions where the inclination of the boom may introduce a risk of tilting over of the working machine. To reduce the risk of such unwanted behaviour of the working machine the operator usually locks the pendulum axle manually for instance by pressing a pushbutton in such working conditions. However, operating conditions may change rapidly when hauling load with the boom.

EP 1426207 A2 discloses an angular sensor arranged in a rotating electrical joint between the upper carriage and the undercarriage of an excavator. The electrical joint is arranged at a rotating thrust bearing device which enables a rotation of the upper carriage relative to the undercarriage. The electrical joint has a number of axially stacked and coaxially arranged disks as electrical contacts. Each disk is contacted with a brush forming a sliding electrical contact on the disk. One disk is an angular sensor defining an angular safety range in which the arm mounted at the upper carriage can be rotated about the horizontal axis without violating a stability criterion of the excavator and consisting of an electrically conductive section of the disk which is otherwise electrically insulating. The angular width of the electrically conductive section corresponds to the angular safety range. The pendulum axle of the excavator is automatically blocked when the rotation of the arm is beyond the angular safety range.

It is desirable to provide a vehicle, particularly a working machine, which has an improved operation comfort and safety for the operator. It is also desirable to provide a method for operating a vehicle in an improved manner regarding comfort and safety.

According to a first aspect of the invention, a vehicle is proposed, particularly a working machine, comprising at least one of (i) an undercarriage and an upper carriage arranged rotatably about a vertical axis with respect to the undercarriage and (ii) an undercarriage and an upper carriage a leverage means arranged pivotably about a horizontal axis with respect to the upper carriage, wherein a sensor system is provided for monitoring at least one stability criterion with respect of a tilt movement of the vehicle, and wherein a control unit is coupled to the sensor system for automatically initiating an action and/or performing an action for stabilizing the vehicle depending on the at least one stability criterion. The stability criterion can be a desired weight distribution which provides a stable position of the vehicle. The weight distribution of the vehicle can be varied e.g. by rotating the upper carriage with respect to the undercarriage and/or by changing the inclination of the leverage means.

The sensor system comprises a sensor unit for monitoring the position of the upper carriage with respect to the undercarriage. The sensor system is provided for monitoring a position of the upper carriage with respect to the undercarriage and an inclination and/or length of the leverage means with respect to the upper carriage. By selecting such elements which may contribute alone or in combination to an instable position of the vehicle for monitoring and reacting appropriately, safe operation of the vehicle can be increased. The operator can concentrate on operating the vehicle and the tools attached to the vehicle.

One or more detecting plates can be arranged at a circumferential portion of a turntable between the upper carriage and the undercarriage being in operative connection with at least one detector for detecting a movement of the one or more detecting plates relative to the detector. For instance, the sensor can issue a signal if and as long as the rotational position of the upper carriage with respect to the undercarriage is in a tolerable range which is stable independent of the inclination of the boom and/or arm and otherwise not. Alternatively, the sensor can issue a signal if and as long as the position of the upper carriage with respect to the undercarriage is in a range which may generate an instable condition dependent of the inclination of the boom and/or arm and otherwise not In other words the sensor (comprising one or more detecting plates and one or more detectors) will issue a signal if and as long as the detecting plate is in an operative connection with the detector and irrespective whether or not the vehicle is in an unstable condition. The control unit that receives the sensor signals will evaluate them and further input signals and will issue a signal if an unstable condition for the vehicle is detected.

The leverage means can be a boom or the like. Depending on the inclination and/or length of the leverage means, weight of the leverage means (and, where applicable, including its load) can add to another weight at a particular location of the vehicle which under unfavourable overall weight distribution conditions can overload a certain part of the vehicle which in turn can have the effect that the vehicle tilts over. The vehicle can for instance be a working machine as an excavator with a tiltable leverage means, a pipe layer with a fixed arm, a material handler for handling goods e.g. in a harbour, a demolition machine for demolition of e.g. buildings, an excavator with a telescope arm, and the like.

Generally, the vehicle can be positioned on even ground or on a slope. Therefore, it is advantageous in a preferred embodiment of the invention to provide the vehicle also with an inclination sensor which indicates the inclination of the vehicle relative to the horizontal plane so that the information about the sensed position and/or inclination of the upper carriage and/or the leverage means can be combined together with the sensed inclination of the vehicle on the slope relative to the horizontal plane as input parameters for the control unit according to the invention.

The slope on which the vehicle is positioned can either improve the stability of the vehicle or increase the risk of instability, depending on how the undercarriage and the upper carriage are positioned with respect to the slope. For instance, with a vehicle on a slope the rotational position of the upper carriage alone (i.e. in cases where the influence of any leverage means of the vehicle on the stability of the vehicle is negligible) with respect to the undercarriage as well as with respect to the inclined ground can cause instability of the vehicle. If the vehicle is on a slope, in the preferred embodiment of the invention the control unit can send a warning signal to the vehicle's operator when a risk of instability is detected which, on even ground, would not induce any instability risk, or, alternatively or in addition, the control unit can automatically initiate an action and/or perform an action for stabilizing the vehicle in such a situation. In doing so the risk that this unwanted instability of the vehicle occurs can be considerably reduced even in cases where the operator had not manually initiated a stabilization of the vehicle before starting the working operation when the vehicle is on a slope. As a further advantage it is noted that an operator of such a vehicle is less distracted from the operation of the vehicle under working conditions because he is being released (i) from being forced to interrupt the work he is carrying out in order to manually initiate the stabilization of the vehicle, e.g. by locking or braking a pendulum axle or the like, or (ii) from continuously watching the necessity to initiate such stabilization.

A pendulum axle has wheels of the vehicle (for instance of an excavator) (i) directly attached to axle portions of the pendulum axle or (ii) pivotably attached in case the pendulum axle is a steerable axle of the vehicle, resulting in a change of the wheel camber when cushioning or rebounding. These axle portions are pivotable with respect to a middle portion (e.g. a differential) of the pendulum axle.

When one of the wheels attached to the pendulum axle runs over an obstacle, the respective axle portion pivots with respect to the other axle portion, e.g. the wheel that hit the obstacle moves upward in order to roll over the obstacle. When the pendulum axle is locked, however, the axle portions cannot move or bend with respect to each other.

According to a favourable embodiment of the invention, the leverage means can comprise a boom pivotably attached to the upper carriage and usually also an arm pivotably attached to the boom. Particularly, the boom can be a monoboom with a pivot joint to the upper carriage and a pivot joint to the arm. The monoboom can be straight or bent. Alternatively, the boom can be a 2-piece boom where in between the two pivot joints mentioned above an additional pivot joint is arranged so that the boom consists of two portions which can be pivoted about a pivot axle, thus yielding a higher flexibility of the boom operation. It is possible to mount a sensor between the two boom parts in order to detect the relative positions of the two boom parts. In cases when the boom is in an upright position, e.g. in a most rearward position, and the upper carriage turns crosswise relative to the undercarriage, a heavy counterweight at the rear end of the upper carriage can cause a tilting over the rear end of the vehicle as the weight of the boom and arm add to the weight of the counterweight or, at least, does not compensate enough the weight of the counterweight. Particularly in cases where the vehicle is equipped with a pendulum axle, this can result in an instable position as the side of the pendulum axle which experiences this load can give way and the vehicle can tilt.

According to a favourable embodiment of the invention, a pendulum axle of the undercarriage can be automatically lockable and/or automatically brakeable depending on the at least one stability criterion. Particularly, the pendulum axle can be a front axle of the vehicle which can also be a steering axle of the vehicle.

The pendulum axle can also be a rear axle. By automatically locking and/or automatically braking the pendulum axle the operator is released from monitoring the position of the upper carriage with respect to the undercarriage and the position of the boom. Even if the operator would forget to lock or to brake the pendulum axle manually, the pendulum axle will be secured as this is done automatically. Optionally, an additional warning can be issued to the operator.

If the locking or braking of the pendulum axle is not enough to reach a stable condition, one expedient measure is to stop the movement and/or to motivate the operator to rotate the leverage means and/or the upper carriage in that direction that is needed to stabilize the vehicle. Particularly, if the vehicle is located on a slope the operator can be motivated to change the location and/or position of the vehicle towards a position that is stable when conducting the planned operation.

According to a favourable embodiment of the invention, a detecting plate can be provided for monitoring the inclination and/or length of the boom with respect to the upper carriage. Expediently a sensor can be arranged in one or more pivotable joints of the leverage means, e.g. between the boom and an arm, so that the length of the leverage means can be derived from the relative pivot angels of pivotable sections of the leverage means.

For instance, the sensor can issue a signal if and as long as the inclination of the boom and/or arm sensor in pivotable joint between boom and arm is in a tolerable range independent of the rotational orientation of the upper carriage with respect to the undercarriage and otherwise not. Alternatively, the sensor can issue a signal if and as long as the inclination of the boom and/or arm is in a range which may be generate an instable condition dependent of the rotational orientation of the upper carriage with respect to the undercarriage and otherwise not In other words the sensor (comprising one or more detecting plates and one or more detectors) will issue a signal if and as long as the detecting plate is in an operative connection with the detector and irrespective whether or not the vehicle is in an unstable condition. The control unit that receives the sensor signals will evaluate them and further input signals and will issue a signal if an unstable condition for the vehicle is detected.

Generally all kinds of sensor units can be used, e.g. magnetic, optical, infrared sensor units and the like.

Favourably, the vehicle can be embodied as an excavator, for instance with a tillable leverage means or with a telescope arm. Favourably, the excavator provides a comfortable and safe operation. However, the vehicle can also be a pipelayer (for instance with a fixed arm), a material handler for handling goods e.g. in a harbour, a demolition machine for demolition of e.g. buildings, and the like.

According to another aspect of the invention, a method for operating a vehicle is proposed, particularly a working machine, wherein an upper carriage performs a rotational movement about a vertical axis with respect to an undercarriage comprising the steps of monitoring at least one stability criterion with respect of a tilt movement of the vehicle, and initiating automatically an action and/or performing an action for stabilizing the vehicle depending on the at least one stability criterion. The stability criterion can be a desired weight distribution which provides a stable position of the vehicle. By automatically initiating and/or performing an action for stabilizing the operator is released from additional work and can concentrate on operating the vehicle.

One or more detecting plates being arranged at a circumferential portion of a slew unit between the upper carriage and the undercarriage are in operative connection with at least one detector for detecting a movement of the one or more detecting plates relative to the detector, wherein either the sensor issues a signal if and as long as the rotational position of the upper carriage with respect to the undercarriage is in a tolerable range which is stable independent of the inclination of a boom and/or arm and otherwise not; or the sensor issues a signal if and as long as the rotational position of the upper carriage with respect to the undercarriage is in a range which may generate an instable condition dependent on the inclination of a boom and/or arm and otherwise not; and wherein the control unit receiving the sensor signals evaluates the sensor signals and further input signals and issues a signal if an unstable condition for the vehicle is detected.

The vehicle can for instance be a working machine as an excavator with a tiltable leverage means, a pipe layer with a fixed arm, a material handler for handling goods e.g. in a harbour, a demolition machine for demolition of e.g. buildings, an excavator with a telescope arm, and the like.

According to a favourable method step, automatically locking and/or automatically braking a pendulum axle of the undercarriage is performed depending on the at least one stability criterion. Expediently, when a weight distribution of the vehicle is unfavourably and may cause instability of the vehicle during operation, the pendulum axle can be locked or braked automatically without interference of the operator.

According to a favourable method step, the steps can be provided of monitoring a position of the upper carriage with respect to the undercarriage; monitoring an inclination and/or a length of a leverage means (for instance a boom or a boom and an arm pivotably connected with the boom) with respect to the upper carriage; combining the monitored position and inclination and/or length for determining a risk of instability of the vehicle; comparing the combined monitored position and inclination and/or length with at least one stability criterion; and locking and/or braking a pendulum axle automatically as long as the at least one stability criterion is violated.

According to a favourable method step, locking and/or braking a pendulum axle can be performed automatically when neither a signal from a sensor monitoring a position of the upper carriage with respect to the undercarriage nor a signal from monitoring an inclination and/or a length of a leverage means (for instance a boom or a boom and an arm pivotably connected with the boom) with respect to the upper carriage is sent to a control unit for automatically initiating an action and/or performing an action for stabilizing the vehicle. Advantageously, locking or braking the pendulum axle is done only in cases where the weight distribution in the vehicle is critical so that risk of tilting of the vehicle is probable, i.e. exceeding a predefined threshold of probability. In other operational conditions the pendulum axle is unlocked and can provide its desired driving characteristics.

The method can be implemented as hardware, as software or as combination of hardware and software. Particularly, a computer program can be provided comprising a computer program code adapted to perform the inventive method or for use in a method when said program is run on a programmable microcomputer. The computer program can be adapted to be downloaded to a control unit or one of its components when run on a computer which is connected to the internet.

A computer program product stored on a computer readable medium can be provided, comprising a program code for use in the inventive method on a computer.

BRIEF DESCRIPTION OF THE DRAWINGS

The present invention together with the above-mentioned and other objects and advantages may best be understood from the following detailed description of the embodiment shown in the Figures, but not restricted to the embodiment, wherein is shown schematically.

DETAILED DESCRIPTION

Figure 1:
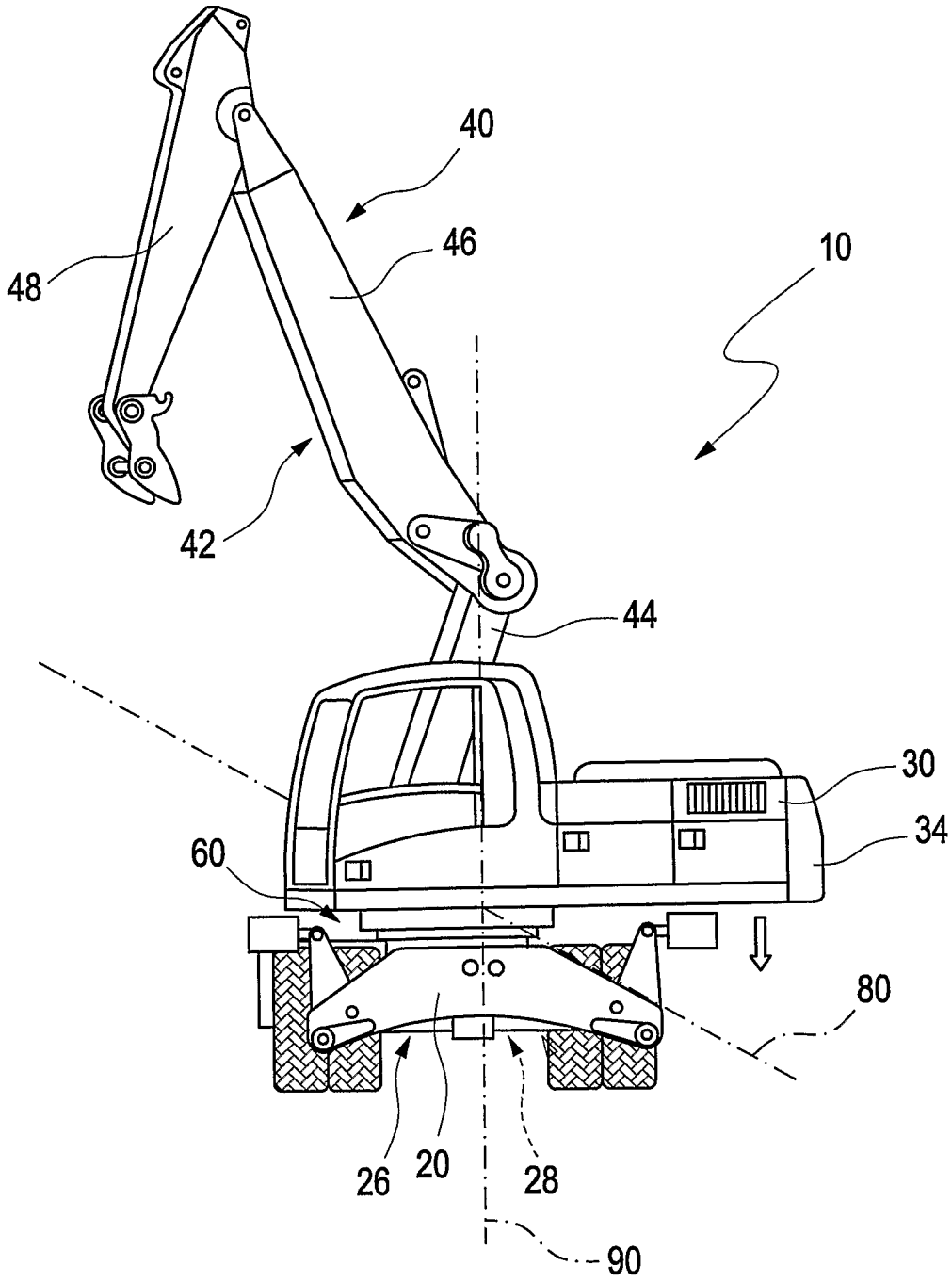
FIG. 1 an excavator with an upper carriage rotated with respect to an undercarriage in a possible tilting position, in a perspective view.

In the drawings, equal or similar elements are referred to by equal reference numerals. The drawings are merely schematic representations, not intended to portray specific parameters of the invention. Moreover, the drawings are intended to depict only typical embodiments of the invention and therefore should not be considered as limiting the scope of the invention.

Figure 2:
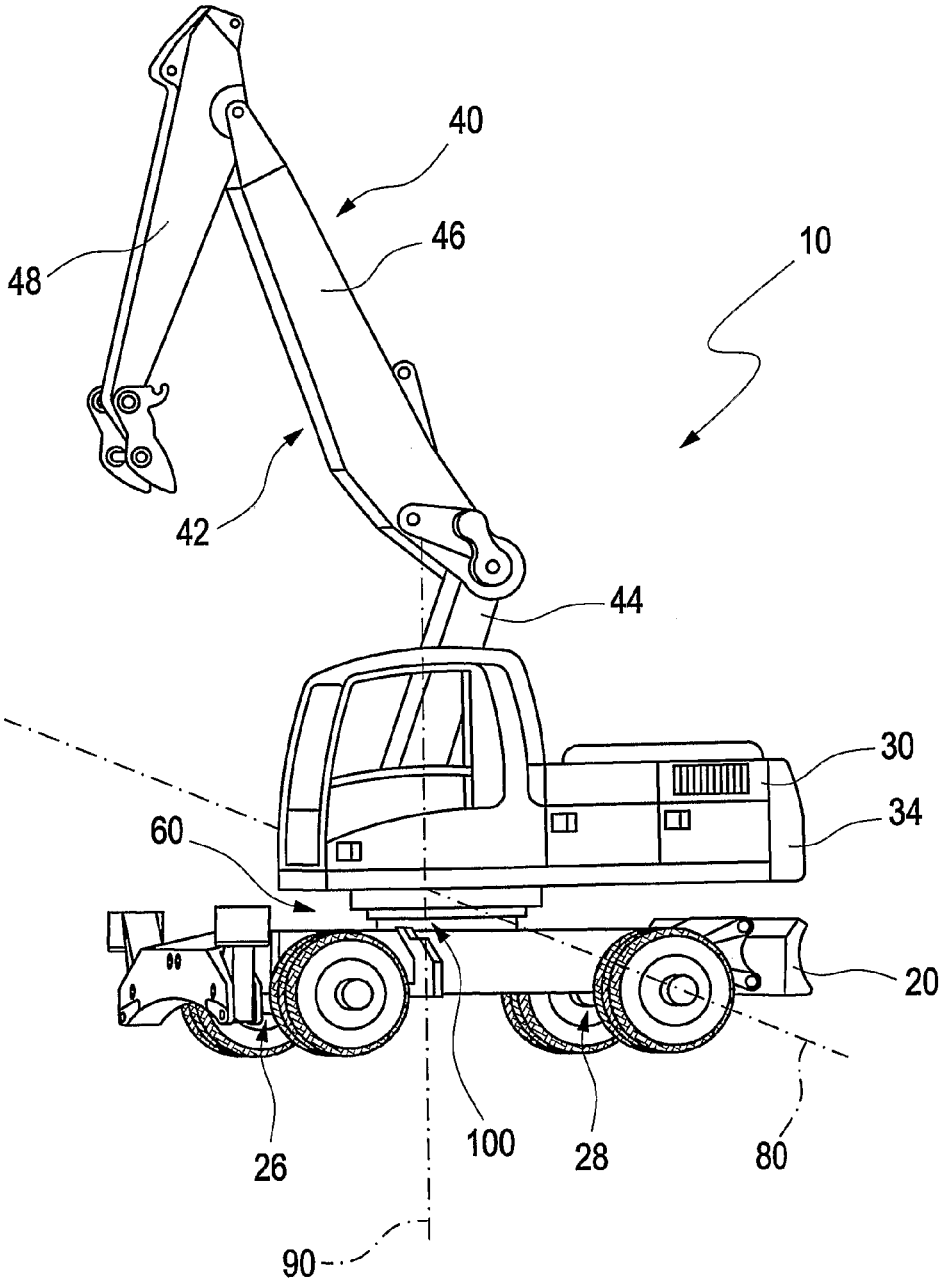
FIG. 2 a side view of the excavator of FIG. 1 with the upper carriage aligned with the under carriage, in a perspective view.

FIG. 1 and FIG. 2 depict in a perspective way a vehicle 10, by way of example embodied as an excavator, comprising an undercarriage 20 and an upper carriage 30. The upper carriage 30 is arranged rotatably about a vertical axis 90 with respect to the undercarriage 20. The upper carriage 30 is connected to the undercarriage 20 via a slew unit 60. A balancing counterweight 34 is arranged at the rear end of the upper carriage 30 which is provided to counteract a load carried by an attachment formed by a leverage means 40 (including, where applicable, any load (not shown)), for instance a boom 42 with a pivotably attached arm 48. The leverage means 40 is attached to the upper carriage 30 by a joint and is pivotable about a horizontal axis 80. The weight distribution of the vehicle 10 is non-uniform for counterbalancing a movement of the leverage means 40 and the upper carriage 30 with the help of a counterweight 34. In FIG. 1 the upper carriage 30 is rotated by an angle of about 90° compared with its relative orientation to the undercarriage as shown in FIG. 2. In FIG. 2 the vehicle 10, e.g. an excavator is shown in a constellation ready for driving away with the upper carriage 30 being aligned with the undercarriage 20. In such a constellation, the upper carriage 30 is not rotated with respect to the undercarriage 20.

The boom 42 may be a monoboom or, like in the example shown in the FIGS. 1 and 2, be composed of a lower section 44 pivotably connected at one end to the upper carriage 30 and an upper boom section 46, at one end pivotably connected with the other end of the lower boom section 44 of the boom 42. At the other end of the upper section 46 of the boom 42 the arm 48 is pivotably attached.

In FIG. 1, the upper carriage 30 is rotated by about 90° about the vertical axis 90 with respect to the undercarriage 20 and has at its rear end a large overhang over the undercarriage 20. In case shown in FIG. 1 the leverage means 40 is—in respect to weight distribution and vehicle stability aspects—in an unfavourable upright position towards the rear end of the upper carriage 30 and the arm 48 lowered into an almost vertical position, resulting in an overall weight distribution at the vehicle 10 which in an unfavourable way has a lot of weight in the rear region of the upper carriage 30 which in the shown position causes a huge (and•unwanted) leverage effect that is downwardly directed which in turn "pulls the rear end of the upper carriage 30 downwards, as indicated by an arrow in FIG. 1.

The vehicle 10 is provided by way of example with a pendulum axle 26, e.g. as front axle, and with a rigid rear axle 28. FIG. 2 shows the vehicle 10 embodied as an excavator, as a side view. According to the invention, a sensor system 100 is provided for monitoring at least one stability criterion with respect of a tilt movement of the undercarriage 20.

Figure 3:
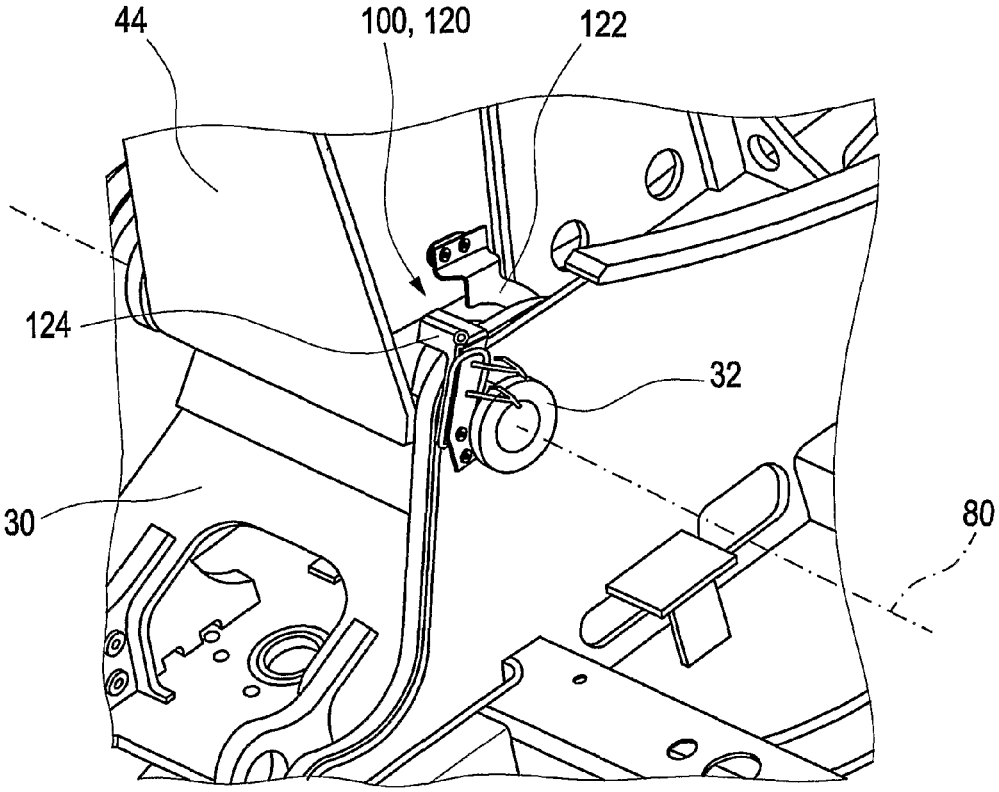
FIG. 3 a detail of the boom of the excavator of FIG. 1 showing a sensor at the boom, in a perspective view from the side.

More particularly, as shown in FIG. 3, the sensor system 100 may comprise a sensor unit 120 assigned to the leverage means 40 which is attached to the upper carriage 30 in a pivot joint. FIG. 3 displays (as an example) a sensor arrangement with a detecting plate 122 attached to the moving part, i.e. the lower boom section 44 of the leverage means 40, and a detector 124 attached to the upper carriage 30. The lower boom section 44 is pivot-mounted by the joint 32 and pivotable about the horizontal axis 80. The detector 124 has a certain predefined angular sector around the axis 80 within which it can detect signals ("detection range"). The detector 124 may be expediently arranged in a housing for protecting the detector 124.

Figure 5:
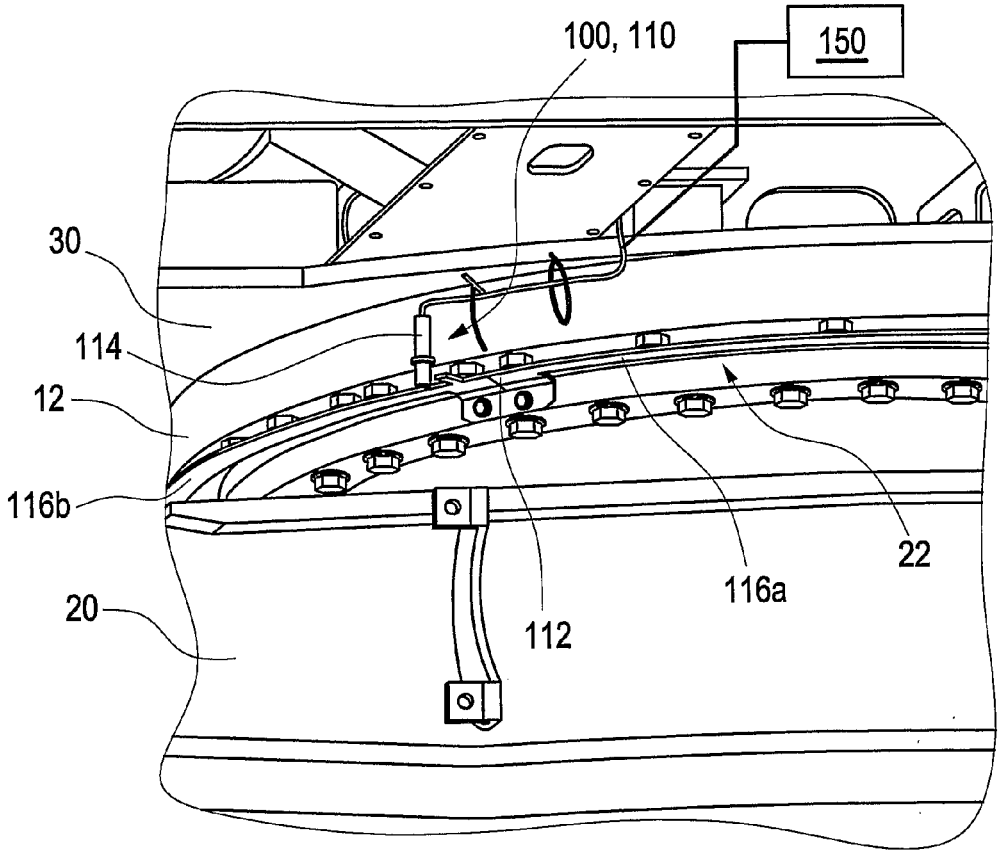
FIG. 5 a detail of the slew unit of FIG. 4 showing further details of the sensor unit of FIG. 4 from the side.

The sensor unit 120 is coupled to a control unit such as an electronic control unit ("ECU") (150 as indicated in FIG. 5). As long as the detecting plate 122 is in operational connection with the detector 124, the sensor unit 120 sends a corresponding sensor signal to the ECU 150. Operational connection means that the detector 124 can detect the detecting plate 122 as long as the detecting plate 122 is located within the detection range of detector 124, and in such case a corresponding first sensor signal ("detecting plate detected") is sent by the detector 124 to the ECU 150. If the detecting plate 122 is moved (by rotation around the horizontal axis 80) to a position outside the detection range of the detector 124, the sensor unit 120 sends another sensor signal ("no detecting plate detected") to the ECU 150. In the embodiment of FIG. 3, the detecting plate 122 is attached to the boom 42. If the boom 42 is rotated the detector 124 sends a signal indicating "no detecting plate detected" as soon as the detecting plate 122 has left the detection range of the detector 124. This sensor signal can be zero, for instance.

Figure 4:
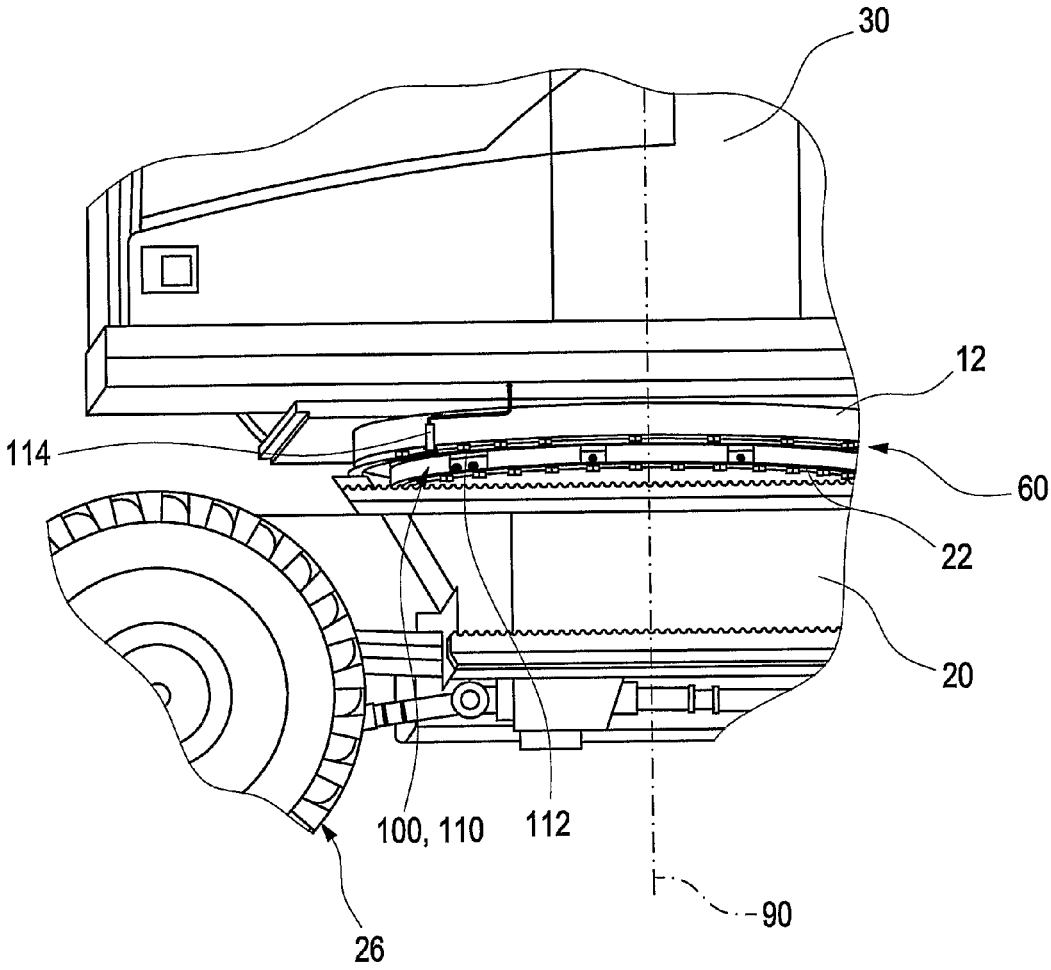
FIG. 4 a detail of the slew unit of the excavator of FIG. 1 showing details of a sensor at the slew unit from the side.
Figure 6:
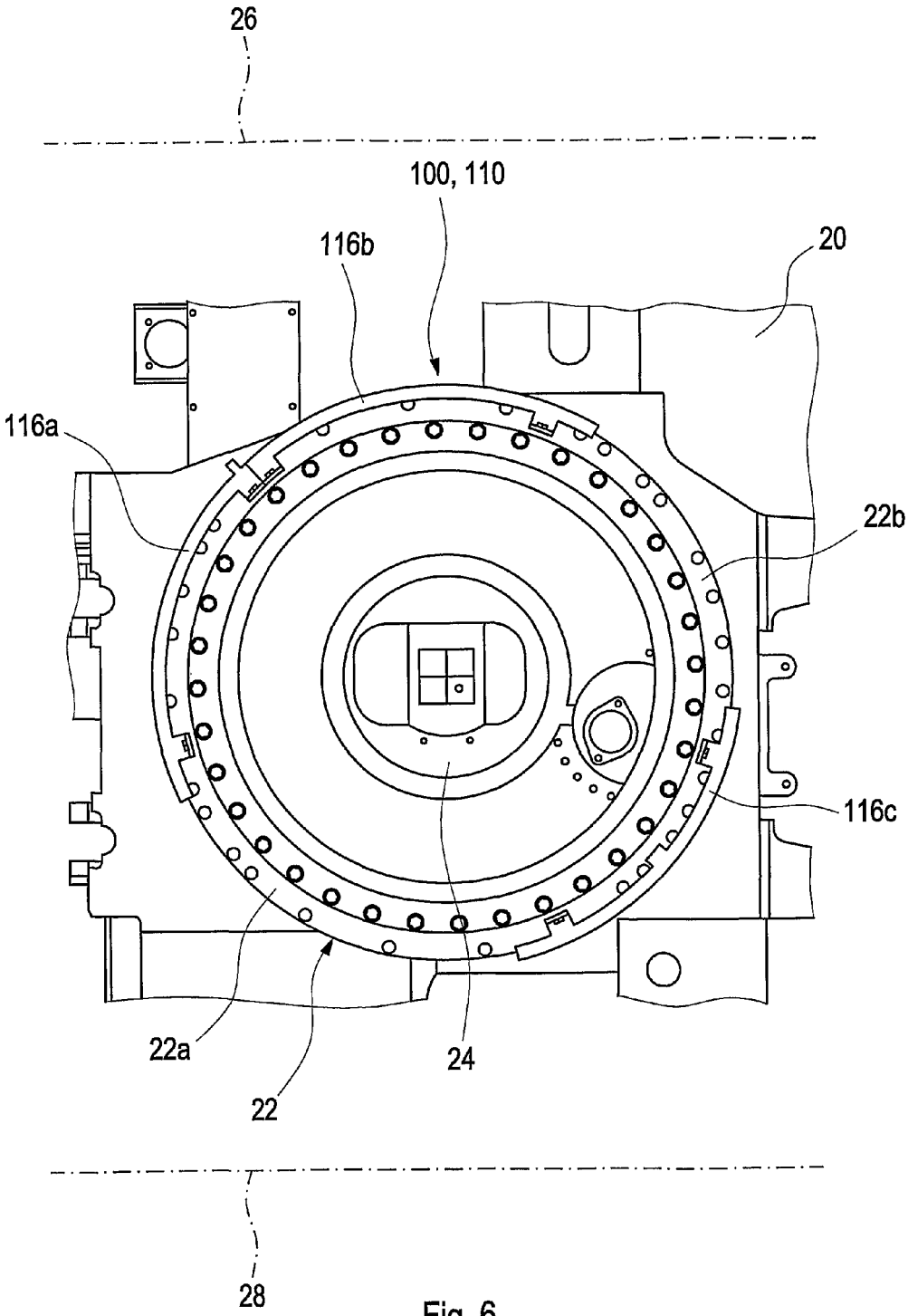
FIG. 6 a part of the slew unit of FIG. 4 with a part of the sensor unit of FIG. 4 as a top view.

A detail of a further sensor unit 110 of the sensor system 100 assigned to the slew unit 60 arranged between the upper carriage 30 and the undercarriage 20 is shown in FIG. 4 and FIG. 5 inside views and in FIG. 6 in a top view.

The sensor unit 110 of the sensor system 100 is provided for monitoring the position of the upper carriage 30 with respect to the undercarriage 20. Detecting plates 116*a*, 116*b*, 116*c* are arranged at a circumferential portion of the slew unit 60 between the upper carriage 30 and the undercarriage 20. The upper carriage 30 is connected to undercarriage 20 in the centre portion 24 of the slew unit 60 and can be rotated about a vertical axis (axis 90 in FIGS. 1 and 2) located in the centre portion 24 relative to the undercarriage 20.

The detecting plates 116*a*, 116*b*, 116*c* are formed as ring sectors and are attached to the outer circumference of a circular carrier plate 22 of the slew unit 60 arranged at the undercarriage 20. The detecting plates 116*a*, 116*b*, 116*c* characterize the circumferential portions of the slew unit 60 which indicate a tolerable position of the upper carriage 30 with respect to tilt stability of the vehicle 10 (FIG. 1, FIG. 2). Further circumferential sectors 22*a*, 22*b* of the carrier plate 22 are arranged between the detecting plates 116*a*, 116*b* and the detecting plate 116*c*. The detecting plates 116*a*, 116*b*, 116*c* are attached to the carrier plate 22 with brackets 112. Further, at least one detector 114 is attached to a slew ring 12 which in turn is mounted at the upper carriage 30. The detector 114 has a detection range that is very narrow and directed downwardly onto the outer circumference of the circular carrier plate 22 which the detecting plates 116*a*, 116*b*, 116*c* are attached at.

The sensor unit 110 is coupled to the ECU 150 (indicated in FIG. 5). As long as the detecting plates 116*a*, 116*b* and 116*c* are in operational connection with the at least one detector 114, the sensor unit 110 sends a corresponding sensor signal to the ECU 150. Operational connection means that the detector 114 can detect a corresponding detecting plate 116*a*, 116*b* or 116*c*, as long as that detecting plate 116*a*, 116*b*, or 116*c* is located more or less directly under the detector. 114, and in such case a corresponding first sensor signal ("detecting plate detected") is sent by the detector 114 to the ECU 150. If the upper carriage 30 is rotated about the vertical axis (90 in FIGS. 1 and 2) and there is none of the detecting plates 116*a*, 116*b*, 116*c* within the (narrow) detection range of the sensor 114 (which is the case in the further circumferential sectors 22*a* and 22*b*), the sensor unit 110 sends another sensor signal ("no detecting plate detected") to the ECU 150. This sensor signal can be zero, for instance.

The sectors 22*a*, 22*b* are arranged on the carrier plate 22 in such a way that they indicate positions of the upper carriage 30 with respect to the undercarriage 20 which may cause an instability of the excavator 10 in case the detector 114 (arranged at the upper carriage 30) is located above these sectors 22*a*, 22*b* since in these positions the counterweight 34 at the upper carriage 30 is unfavourably placed regarding the balance of the overall weight distribution of the vehicle 10.

The detecting plates 116*a*, 116*b* and 116*c* at the slew unit 60 are circumferentially arranged in an asymmetric way (see FIG. 6). The asymmetric arrangement is a consequence of the fact that in the selected example the vehicle 10 (FIGS. 1 and 2) is equipped with one pendulum axle 26 (indicated by a dotted, line in the upper part of FIG. 6) and with one rigid rear axle 28 (indicated by a dotted line in the lower part of FIG. 6).

Figure 7:
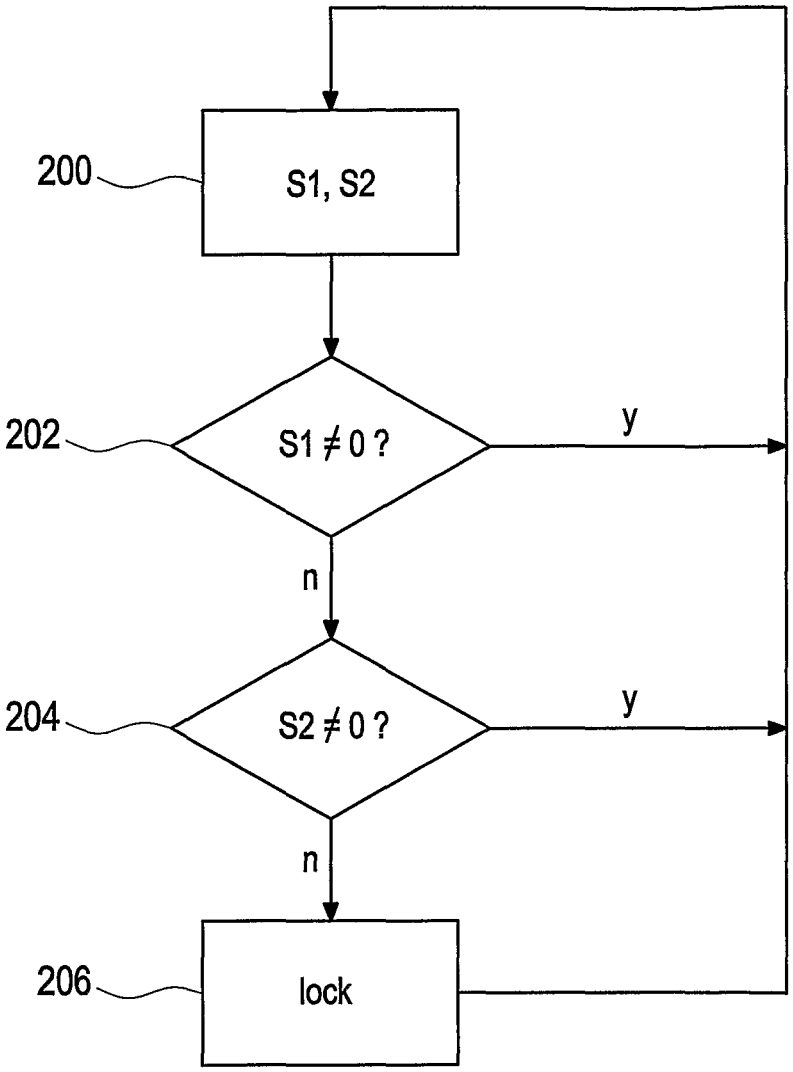
FIG. 7 a flow diagram describing an advantageous embodiment of the method according to the invention for use in a vehicle located on an even ground.

FIG. 7 illustrates an example of an operation method according to the invention. It is assumed that the vehicle 10 is located or moving on even (horizontal or substantially horizontal) ground so that there may be a risk of an unexpected tilting of the vehicle 10 for example over the rear end of the upper carriage 30 due to an unfavourable combination of the counterweight position and the current operative status of the pendulum axis 26. The method for operating the vehicle 10 (here; a working machine as for instance the excavator 10 in FIG. 1, FIG. 2) comprises the steps of monitoring at least one stability criterion with respect of a tilt movement of the undercarriage 20 of the excavator 10, and initiating automatically an action and/or performing an action for stabilizing the working machine 10 depending on the at least one stability criterion. The reference numbers used in connection with the description of FIGS. 7 and 8 for the excavator and its components including the sensor system 100 and its components refer to the preceding FIGS. 1-6.

In step 200, sensor signals S1 sent from the sensor unit 110 and sensor signals sent from the sensor unit 120 of the sensor system 100 are monitored in the ECU 150. If the upper carriage 30 of the excavator 10 is in an uncritical position with respect to the undercarriage 20 and if the leverage means 40 is in a tolerable position with respect to the upper carriage 30, the respective sensor units 110, 120 send signals ("detecting plate 122 detected; detecting plates 116*a*, 116*b*, 116*c* detected") to the ECU 150. Otherwise, i.e. if the upper carriage 30 and the leverage means 40 are not in a tolerable position, the respective sensor units 110, 120 do not send any signal to the ECU 150, i.e. in this example the sensor signals corresponding to "no detecting plates detected" are zero.

In step 202 it is checked whether or not there is a sensor signal S1. If there is a sensor signal S1 ("y" in the flow chart), the routine jumps back to step 200 and continues monitoring the sensor signals S1, S2. If there is no sensor signal S1 ("n" in the flow chart) the routine continues with step 204.

In step 204 it is checked whether or not there is a sensor signal S2 sent from the sensor unit 120. If there is a sensor signal S2 ("y" in the flow chart), the routine jumps back to step 200 and continues monitoring the sensor signals S1, S2. If there is no sensor signal S2 ("n" in the flow chart) the routine continues with step 206.

Of course, the order of S1 and S2 can be reversed, so that it may be checked if there is a sensor signal S2 before it is checked if there is a sensor signal S1.

Step 206 is performed only when there is neither a sensor signal S1 from the sensor unit 110 assigned to the position of the upper carriage 30 with respect to the undercarriage 20 nor a sensor signal S2 from the sensor unit 120 assigned to the inclination of the leverage means 40.

In step 206 the ECU 150 initiates the locking of the pendulum axle 26 of the vehicle 10 automatically. Alternatively, the pendulum axle 26 can be braked. Braking the pendulum axle 26 means a deceleration of tilting during the movement of the pendulum axle 26 which means an absorption of kinetic energy. Optionally, a warning can be sent to the operator to show that the vehicle is close to critical tilting position.

Advantageously, if a critical combination of the position of the upper carriage 30 and an inclination of the leverage means 40 occurs, the pendulum axle 26 will be secured (i.e. locked or braked) and the risk of an unexpected tilting of the vehicle 10 over the rear particularly on flat and solid ground due to an unfavourable weight distribution can be considerably reduced.

While the logic of the flow diagram is working well if the vehicle 10 is on even ground, in case the vehicle 10 is on a slope, the inclination of the slope and the actual weight distribution of the vehicle with respect to the slope has to be taken into account. For instance, if the locking or braking of the pendulum axle 26 is not enough to reach a stable condition it is possible to stop the actual movement of the leverage means 40 and/or the upper carriage 30 and to alarm the operator to rotate the leverage means 40 and/or the upper carriage 30 in a direction that is needed to stabilize the vehicle 10. In doing so the operator is stimulated to change the location and/or position of the vehicle 10 towards a position that is stable when conducting the planned operation. Favourably, the ECU 150 may even give an indication how the vehicle 10 should be moved, e.g. turned, to reach a position which has a higher stability during operation of e.g. the leverage means 40.

Figure 8:
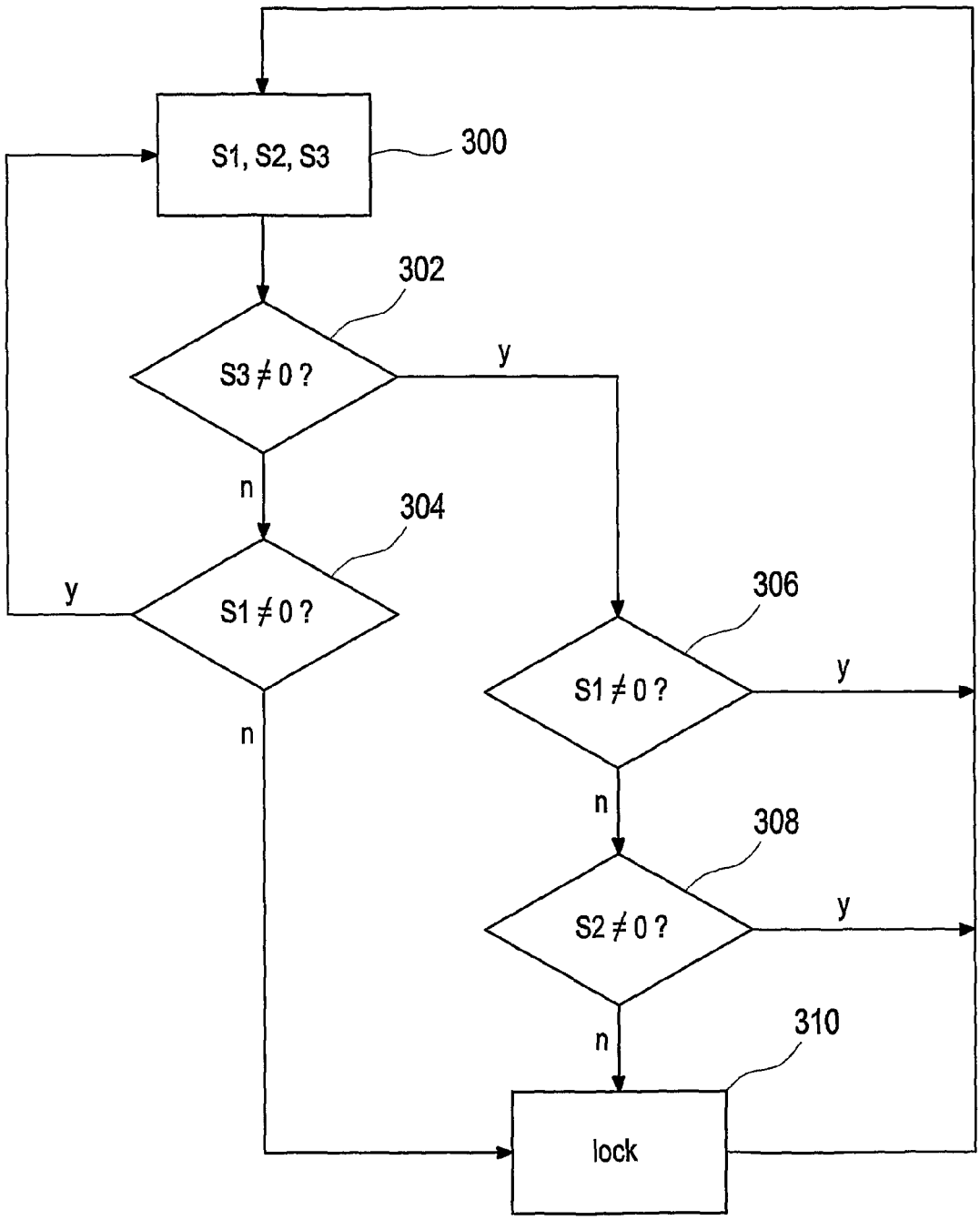
FIG. 8 a flow diagram describing an advantageous embodiment of the method according to the invention for use in a vehicle located on a slope.

An example is given in the flow chart depicted in FIG. 8. In step 300, sensor signals S1 sent from the sensor unit 110, sensor signals S2 sent from the sensor unit 120 and sensor signals S3 send from a further sensor unit "slope sensor" (not shown in FIGS. 1-6) of the sensor system 100 are monitored in the ECU 150. If the upper carriage 30 is in an uncritical position with respect to the undercarriage 20, if the leverage means 40 is in a tolerable position with respect to the upper carriage 30 (and the counterweight 34) and if the vehicle 10 itself is not on a slope or on a slope with an inclination angle from the horizontal plane that does not exceed a predefined threshold angle, the respective sensor units 110, 120 and the slope sensor unit do send signals to the ECU 150. Otherwise, i.e. if the upper carriage 30 and/or the leverage means 40 and/or the vehicle 10 itself (e.g. if the vehicle 10 is positioned on a slope with an inclination angle from the horizontal plane that does exceed said predefined threshold angle) are not in a tolerable position, the respective sensor units 110 and 120 do not send any signal to the ECU 150, i.e. in such cases the corresponding sensor signals are zero.

In step 302 it is checked whether or not there is a sensor signal S3. If there is a sensor signal S3 ("y" in the flow chart), the routine continues with step 306. If there is no sensor signal S3 ("n" in the flow chart) the routine continues with step 304.

In step 304 it is checked whether or not there is a sensor signal S1 sent from the sensor unit 110. If there is a sensor signal S1 ("y" in the flow chart), the routine jumps back to step 300 and continues monitoring the sensor signals S1, S2 and S3. If there is no sensor signal S1 ("n" in the flow chart) the routine continues with step 310.

In step 306 it is checked whether or not there is a sensor signal S1. If there is a sensor signal S1 ("y" in the flow chart), the routine jumps back to step 300 and continues monitoring the sensor signals S1, S2 and S3. If there is no sensor signal S1 ("n" in the flow chart) the routine continues with step 308.

In step 308 it is checked whether or not there is a sensor signal S2 sent from the sensor unit 120. If there is a sensor signal S2 ("y" in the flow chart), the routine jumps back to step 300 and continues monitoring the sensor signals S1, S2 and S3. If there is no sensor signal S2 ("n" in the flow chart) the routine continues with step 310.

Of course, the order of S1 and S2 can be reversed, so that it may be checked if there is a sensor signal S2 before it is checked if there is a sensor signal S1.

Step 310 is performed, in this instance, only when there is neither a sensor signal S1 from the sensor unit 110 assigned to the position of the upper carriage 30 with respect to the undercarriage 20 nor a sensor signal S2 from the sensor unit 120 assigned to the inclination of the leverage means 40.

In step 310 the ECU 150 initiates the locking of the pendulum axle 26 of the vehicle 10 automatically. Alternatively, the pendulum axle 26 can be braked. Braking the pendulum axle 26 means a deceleration of tilting during the movement of the pendulum axle 26 which means an absorption of kinetic energy. Optionally, a warning can be sent to the operator to show that the vehicle is close to a critical tilting position.

Advantageously, if a critical combination of the position of the upper carriage 30 with respect to the slope occurs, even on a slope the risk of an unexpected tilting of the vehicle 10 due to an unfavourable weight distribution can be considerably reduced.

The invention claimed is:

1. A vehicle comprising an undercarriage, an upper carriage arranged rotatably about a vertical axis with respect to the undercarriage and a leverage means arranged pivotably about a horizontal axis with respect to the upper carriage, wherein a sensor system is provided for monitoring at least one stability criterion with respect of a tilt movement of the vehicle, and wherein a control unit is coupled to the sensor system for automatically at least one of initiating an action or performing an action for stabilizing the vehicle, depending on the at least one stability criterion, wherein the sensor system comprises a sensor unit for monitoring the position of the upper carriage with respect to the undercarriage, wherein the sensor system is provided for monitoring a position of the upper carriage with respect to the undercarriage and at least one of an inclination or length of the leverage means with respect to the upper carriage, wherein the sensor unit comprises detecting plates formed as ring sectors which are arranged at a circumferential portion of a slew unit between the upper carriage and the undercarriage and being in operative connection with at least one detector for detecting a movement or position of the detecting plates relative to the at least one detector, the detecting plates being attached to the outer circumference of a circular carrier plate of the slew unit arranged at the undercarriage such that the detecting plates indicate positions of the slew unit which characterize circumferential portions indicating a tolerable position of the upper carriage with respect to tilt stability of the vehicle while sectors in between indicate positions which may cause instability, wherein the detecting plates are arranged circumferentially around the outer circumference of the circular carrier plate in a rotationally asymmetric way;

wherein a sensor signal is issued when and as long as a detecting plate is in operative connection with the at least one detector and irrespective whether or not the vehicle is in an unstable condition; wherein the sensor system comprises an inclination sensor for monitoring an inclination of the vehicle with respect to a horizontal or substantially horizontal ground so that information about at least one of the sensed position or inclination of the upper carriage or leverage means of the vehicle can be combined together with the sensed inclination of the vehicle as input parameters for the control unit which issues a signal when an unstable condition for the vehicle is detected.

2. The vehicle according to claim 1, wherein the leverage means comprises (i) only a boom pivotably attached to the upper carriage or (ii) a boom pivotably attached to the upper carriage and an arm pivotably attached to the boom.

3. The vehicle according to claim 1, wherein at least one pendulum axle is arranged at the undercarriage and wherein the at least one pendulum axle of the undercarriage is at least one of automatically lockable or automatically brakable depending on the at least one stability criterion.

4. The vehicle according to claim 1, wherein a sensor unit is provided for monitoring at least one of the inclination or length of a boom with respect to the upper carriage and wherein the sensor unit preferably comprises at least one detecting plate being in operative connection with at least one detector for detecting a movement or position of the at least one detecting plate relative to the detector when the boom moves about the horizontal axis.

5. The vehicle according to claim 4, wherein the detecting plate is attached to a moving lower boom section of the boom and the at least one detector in operational connection to the detecting plate is attached to the upper carriage.

6. A working machine, particularly an excavator, according to claim 1.

7. A method for operating a vehicle, with an upper carriage and an undercarriage, wherein the upper carriage performs a rotational movement about a vertical axis with respect to the undercarriage, comprising:

monitoring at least one stability criterion with respect of a tilt movement of the vehicle, and at least one of initiating automatically an action or performing an action for stabilizing the vehicle depending on the at least one stability criterion, arranging detecting plates formed as ring sectors at a circumferential portion of a slew unit between the upper carriage and the undercarriage in operative connection with at least one detector for detecting a movement of the detecting plates relative to the detector, wherein the detecting plates are attached to the outer circumference of a circular carrier plate of the slew unit arranged at the undercarriage, wherein the detecting plates are arranged circumferentially around the outer circumference of the circular carrier plate in a rotationally asymmetric way;

indicating via the detecting plates positions of the slew unit which characterize circumferential portions indicating a tolerable position of the upper carriage with respect to tilt stability of the vehicle while sectors in between indicate positions which may cause instability;

issuing a sensor signal when and as long as a detecting plate is in operative connection with the at least one detector and irrespective whether or not the vehicle is in an unstable condition; and monitoring an inclination of the vehicle with respect to a horizontal or substantially horizontal ground and combining information about at least one of the sensed position or inclination of the upper carriage or leverage means of the vehicle together with the sensed inclination of the vehicle as input parameters for a control unit which issues a signal when an unstable condition for the vehicle is detected.

8. The method according to claim 7, further comprising:

at least one of (i) monitoring a position of the upper carriage with respect to the undercarriage or (ii) for a vehicle equipped with a leverage means, monitoring at least one of an inclination or a length of the leverage means of the vehicle with respect to the upper carriage; and assessing the at least one of (i) the monitored position or (ii) the monitored inclination and length;

for determining a risk of instability of the vehicle, on the basis of at least one stability criterion.

9. The method according to claim 7, for a vehicle equipped with at least one pendulum axle arranged at the undercarriage, further comprising at least one of locking or braking the pendulum axle automatically if and as long as the at least one stability criterion is violated.

10. The method according to claim 9, further comprising at least one of locking and braking the pendulum axle automatically when neither a signal from a sensor system monitoring a position of the upper carriage with respect to the undercarriage nor a signal from monitoring at least one of an inclination or the length of a leverage means with respect to the upper carriage is sent to a control unit for at least one of automatically initiating an action or performing an action for stabilizing the vehicle.

11. Computer comprising a control unit and a computer program comprising a computer program code adapted to perform a method for operating a vehicle, with an upper carriage and an undercarriage, wherein the upper carriage performs a rotational movement about a vertical axis with respect to the undercarriage, the method comprising:

monitoring at least one stability criterion with respect of a tilt movement of the vehicle, and at least one of initiating automatically an action or performing an action for stabilizing the vehicle depending on the at least one stability criterion, using detecting plates formed as ring sectors at a circumferential portion of a slew unit between the upper carriage and the undercarriage in operative connection with at least one detector for detecting a movement of the detecting plates relative to the detector, wherein the detecting plates are attached to the outer circumference of a circular carrier plate of the slew unit arranged at the undercarriage, wherein the detecting plates are arranged circumferentially around the outer circumference of the circular carrier plate in a rotationally asymmetric way;

indicating via the detecting plates positions of the slew unit which characterize circumferential portions indicating a tolerable position of the upper carriage with respect to tilt stability of the vehicle while sectors in between indicate positions which may cause instability;

issuing a sensor signal when and as long as a detecting plate is in operative connection with the at least one detector and irrespective whether or not the vehicle is in an unstable condition; and monitoring an inclination of the vehicle with respect to a horizontal or substantially horizontal ground and combining information about at least one of the sensed position or inclination of the upper carriage or leverage means of the vehicle together with the sensed inclination of the vehicle as input parameters for the control unit which issues a signal when an unstable condition for the vehicle is detected.

12. Computer connected to the internet, the computer comprising a computer program downloaded from the internet to a control unit, the program being adapted to perform a method for operating a vehicle, with an upper carriage and an undercarriage, wherein the upper carriage performs a rotational movement about a vertical axis with respect to the undercarriage, the method comprising:

monitoring at least one stability criterion with respect of a tilt movement of the vehicle, and at least one of initiating automatically an action or performing an action for stabilizing the vehicle depending on the at least one stability criterion, using detecting plates formed as ring sectors at a circumferential portion of a slew unit between the upper carriage and the undercarriage in operative connection with at least one detector for detecting a movement of the detecting plates relative to the detector, wherein the detecting plates are attached to the outer circumference of a circular carrier plate of the slew unit arranged at the undercarriage, wherein the detecting plates are arranged circumferentially around the outer circumference of the circular carrier plate in a rotationally asymmetric way;

indicating via the detecting plates positions of the slew unit which characterize circumferential portions indicating a tolerable position of the upper carriage with respect to tilt stability of the vehicle while sectors in between indicate positions which may cause instability;

issuing a sensor signal when and as long as a detecting plate is in operative connection with the at least one detector and irrespective whether or not the vehicle is in an unstable condition; and monitoring an inclination of the vehicle with respect to a horizontal or substantially horizontal ground and combining information about at least one of the sensed position or inclination of the upper carriage or leverage means of the vehicle together with the sensed inclination of the vehicle as input parameters for the control unit which issues a signal when an unstable condition for the vehicle is detected.

13. Computer program product stored on a non-transitory computer readable medium, comprising a program code adapted to perform a method on a computer, the method being for operating a vehicle, with an upper carriage and an undercarriage, wherein the upper carriage performs a rotational movement about a vertical axis with respect to the undercarriage, the method comprising:

monitoring at least one stability criterion with respect of a tilt movement of the vehicle, and at least one of initiating automatically an action or performing an action for stabilizing the vehicle depending on the at least one stability criterion, using detecting plates formed as ring sectors at a circumferential portion of a slew unit between the upper carriage and the undercarriage in operative connection with at least one detector for detecting a movement of the detecting plates relative to the detector, wherein the detecting plates are attached to the outer circumference of a circular carrier plate of the slew unit arranged at the undercarriage, wherein the detecting plates are arranged circumferentially around the outer circumference of the circular carrier plate in a rotationally asymmetric way;

indicating via the detecting plates positions of the slew unit which characterize circumferential portions indicating a tolerable position of the upper carriage with respect to tilt stability of the vehicle while sectors in between indicate positions which may cause instability;

issuing a sensor signal when and as long as a detecting plate is in operative connection with the at least one detector and irrespective whether or not the vehicle is in an unstable condition; and monitoring an inclination of the vehicle with respect to a horizontal or substantially horizontal ground and combining information about at least one of the sensed position or inclination of the upper carriage or leverage means of the vehicle together with the sensed inclination of the vehicle as input parameters for a control unit which issues a signal when an unstable condition for the vehicle is detected.

* * * * *